United States Patent [19]

Clement

[11] 4,158,998

[45] Jun. 26, 1979

[54] SHELF SUPPORT STRUCTURE

[75] Inventor: Joseph J. Clement, Bradenton, Fla.

[73] Assignee: The Mead Corporation, Dayton, Ohio

[21] Appl. No.: 865,592

[22] Filed: Dec. 29, 1977

Related U.S. Application Data

[63] Continuation of Ser. No. 685,519, May 12, 1976, abandoned.

[51] Int. Cl.[2] ..... A47B 9/00

[52] U.S. Cl. ..... 108/144; 248/243; 211/191

[58] Field of Search ..... 108/107, 108, 110, 111; 211/187, 189, 190, 191, 192; 248/243, 250; 312/257

[56] References Cited

U.S. PATENT DOCUMENTS

| | | | |
|---|---|---|---|
| 1,880,179 | 9/1932 | Onions | 248/243 |
| 2,990,067 | 6/1961 | Bartlett | 108/144 |
| 3,306,466 | 2/1967 | Liston | 108/144 X |
| 3,606,027 | 9/1971 | Clements | 211/191 |

FOREIGN PATENT DOCUMENTS

| | | | |
|---|---|---|---|
| 742575 | 9/1966 | Canada | 248/243 |
| 844989 | 6/1970 | Canada | 211/192 |

*Primary Examiner*—Roy D. Frazier
*Assistant Examiner*—Peter A. Aschenbrenner
*Attorney, Agent, or Firm*—Walter M. Rodgers; Walter A. Rodgers

[57] ABSTRACT

A shelf having a horizontal planar supporting surface and an edge portion is supported by a vertically disposed post having a pair of support strips fixed in angular relation to each other and in each of which a plurality of apertures are formed in vertically spaced relationship together with a support clip having a pair of vertically disposed support panels fixed in angular relation to each other and respectively disposed adjacent said support strips, the angular relation between said support panels corresponding generally with that between said support strips so that the panel and strips are disposed in parallel relationship to each other and wherein at least one support tab is formed on each support panel and disposed in an aperture in the associated support strip, the support tabs being configured so that the shelf edge portion may be firmly gripped between said support strips and their corresponding support panels.

4 Claims, 9 Drawing Figures

SHELF SUPPORT STRUCTURE

This is a continuation of application Ser. No. 685,519 filed May 12, 1976, now abandoned.

Display stands having a plurality of vertically disposed support posts together with a plurality of horizontally disposed shelves supported by the posts must present an attractive appearance and must be constructed so the shelves are readily adjusted vertically to accommodate variations in height of displayed items without impairing the mechanical reliability of the device as a support structure.

According to this invention in one form, a shelf having a planar element and an edge portion is securely interlocked at its corners with vertically disposed corner posts by means of a specially constructed support clip comprising a pair of angularly related support panels to each of which at least one support tab is secured, the tabs being inserted into apertures formed in complimentary support strips comprising parts of each corner post. According to one form of the invention each support tab comprises a horizontal part secured at one end to its associated support panel and a vertically disposed part secured to the other end of the horizontal part and the length of the horizontal part of the support tab is at least as great as the combined thickness of the shelf skirt and the associated support strip so that a gripping action is effectively applied to the shelf skirt whereby the skirt is positively supported by the upper edges of the support panels which engage the planar element of the shelf so that the shelf skirt is gripped and held frictionally but disjointably against substantial vertical movement relative to the corner post and the associated support clip. According to another form of the invention, a shelf having a wire edge portion is arranged so that such edge portion is gripped between a specially configured support panel to provide secure but disjointable support for such a shelf.

For a better understanding of the invention reference may be had to the following detailed description taken in conjunction with the accompanying drawing in which:

FIG. 8 is a perspective view of another form of support clip constructed according to the invention and which is specially adapted for use with a shelf having a wire edge portion; and in which FIG. 9 is a perspective view of a wire shelf which may be supported by the support clip shown in FIG. 8.

Figure 1:
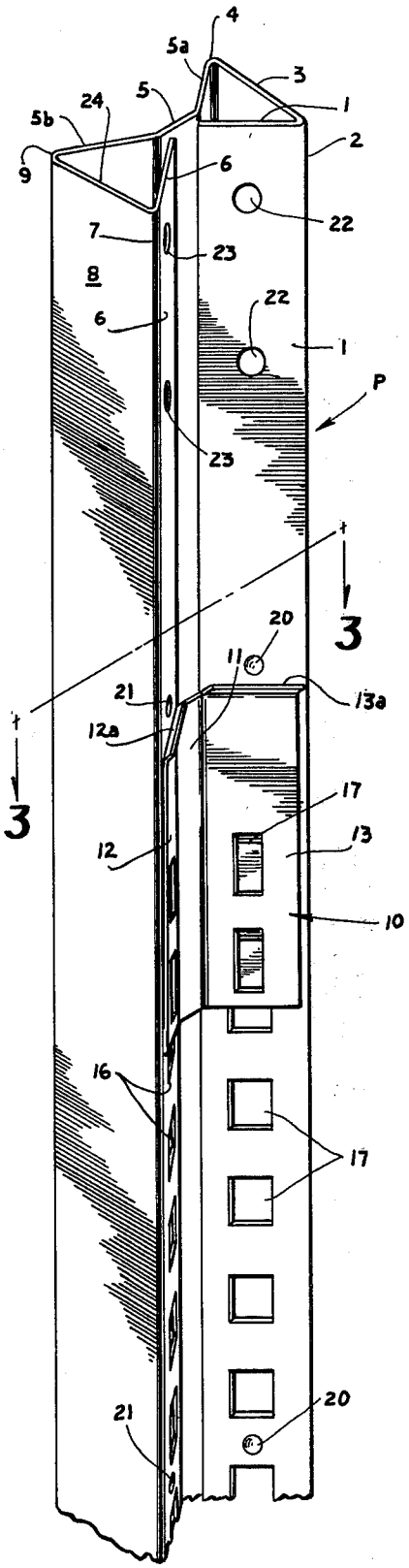
FIG. 1 is a perspective view of a display stand corner post on which a support clip is mounted in accordance with one form of the invention.

The form of the invention shown in FIGS. 1, 2, 3 and 4 utilizes a corner post P in which a support strip 1 is secured along its edge 2 to an edge of a flange panel 3 which in turn is secured at its edge 4 to a side web strip 5*a*. Similarly a support strip 6 is secured along its edge 7 to a flange panel 8 which in turn is secured along its edge 9 to an edge of side web strip 5*b*. Side web strips 5*a* and 5*b* are secured or integrally formed to the side edges of central web strip 5 to form web structure. As is apparent particularly in FIG. 3, support strips 1 and 6 are angularly disposed to each other and for most applications of the invention these panels are disposed in normal relation to each other as viewed for example in FIG. 3 so as to accommodate a corner of a shelf which usually is square. Flange panels 3 and 8 are parallel with each other and are disposed at acute angles with respect to the support strips 1 and 6 respectively. Side web strips 5*a* and 5*b* are disposed at obtuse angles to central web strip 5 as is apparent in FIG. 3.

Figure 2:
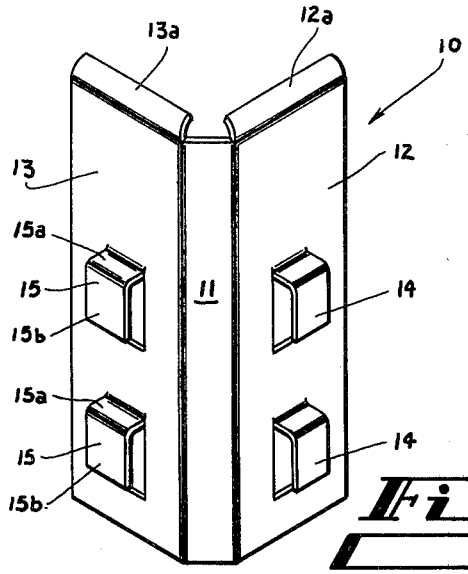
FIG. 2 is a perspective view of the support clip in FIG. 1 shown apart from its associated post.

For interrelating a shelf with the support strips 1 and 6, a support clip generally designated in FIG. 2 by the numeral 10 is provided and is secured to the support strips 1 and 6. The support clip comprises a base panel designated by the numeral 11 together with a pair of support panels designated by the numerals 12 and 13. Support panels 12 and 13 are angularly disposed with respect to each other at an angle which corresponds generally with the angle between support strips 1 and 6 and base panel 11 is diagonally disposed with respect to support panels 12 and 13.

For the purpose of mounting the support clip 10 onto a corner post comprising support strips 1 and 6, at least one support tab 14 is secured to support panel 12 and at least one support tab 15 is secured to support panel 13. Support tabs 14 are inserted into selected ones of the apertures designated by the numeral 16 which are formed in support strip 6 while support tabs 15 are inserted into selected ones of the apertures 17 formed in support strip 1. Of course the particular apertures such as 16 and 17 into which the associated support tabs such as 14 and 15 are inserted determine the height of the support clip 10 relative to the post comprising support strips 1 and 6 and in turn determine the height of the associated shelf.

Figure 3:
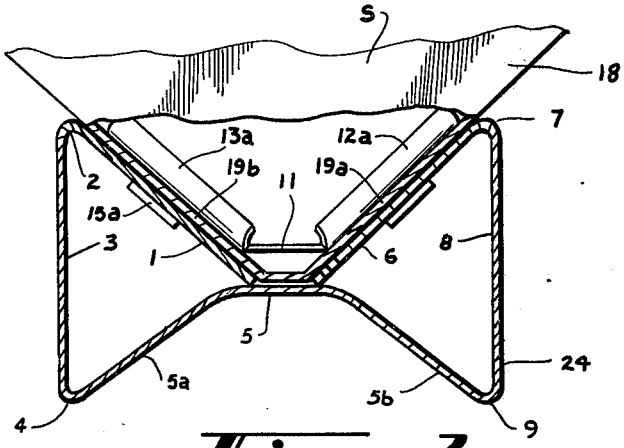
FIG. 3 is a cross sectional view taken along the line designated 3—3 in FIG. 1.
Figure 4:
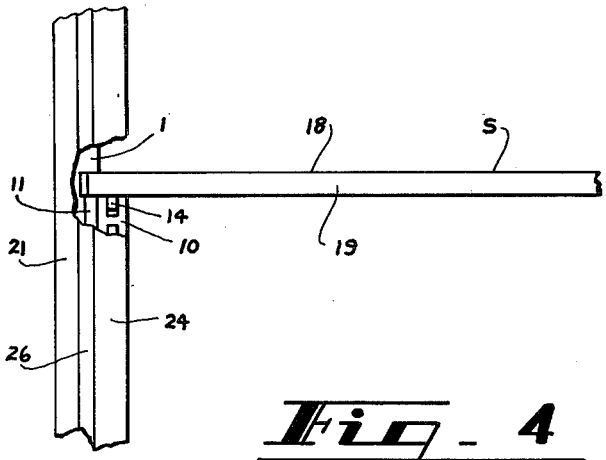
FIG. 4 is a fragmentary view of a corner post together with its associated clip and showing the manner in which the shelf is interrelated with the corner post and clip according to one form of the invention.

As is apparent from FIGS. 3 and 4, the associated shelf S comprises a planar element 18 which is horizontally disposed and an edge portion in the form of a skirt 19 which depends downwardly from the outer periphery of planar element 18.

With a clip such as 10 mounted on the vertically disposed support strips such as 1 and 6 as shown in FIGS. 3 and 4, the shelf is mounted and supported by simply inserting the part 19*a* of skirt 19 between support panel 12 and support strip 6 while the part 19*b* of shelf skirt 19 is secured between the support panel 13 and the support strip 1. This inserting operation is facilitated by the inwardly curved upper ends 12*a* and 13*a* of support panels 12 and 13 respectively. All of the support tabs such as 14 and 15 are of substantially identical construction. As indicated in FIG. 2, support tabs such as 15 comprise a horizontally disposed part 15*a* and a vertically disposed part 15*b*. From FIG. 3 it is apparent that the length of the horizontally disposed part 15*a* must be at least as great as the combined thickness of skirt portion 19*b* of the shelf 18 plus the thickness of support strip 1. When so constructed it is apparent that the shelf S is securely fixed in position relative to the corner posts and their support strips 2 and 6 and substantial horizontal relative movement between the shelf S and the corner posts is precluded. Furthermore the planar element 18 of the shelf S may rest atop the inwardly curved portions 12a and 13a of support panels 12 and 13 and by this means a secure junction is provided at each post which affords a sturdy support for the shelf and the items mounted thereon.

For the purpose of insuring that all corners of a shelf such as S are disposed at the same elevation, dimples 20 and 21 may be formed in support strips 1 and 6 respectively and may constitute recessed or upraised areas readily located by simple finger touch.

For mounting top horizontal cross panels (not shown) at the upper ends of posts P, apertures 22 and 23 are formed in support strips 1 and 6 and bolts or screws (not shown) are inserted through holes in such cross panels and thence into the apertures 22 and 23 to secure the cross panels. Since posts P are generally diagonally disposed to the shelf corners, bolts in apertures 22 and 23 are not observable and the appearance of the display is considerably enhanced. In like fashion, bottom cross panels are secured to posts P by bolts or screws (not shown) the lower end of post P being omitted from FIG. 1. The particular cross sections of post P also shields support clips 10 from view. Because of the right angle between support strips 1 and 6, the shelf corner is accommodated and the diagonal central web strip 5 enhances appearance and with side web strips 5a and 5b contributes to the strength of the posts and may be decorated attractively.

Figure 5:
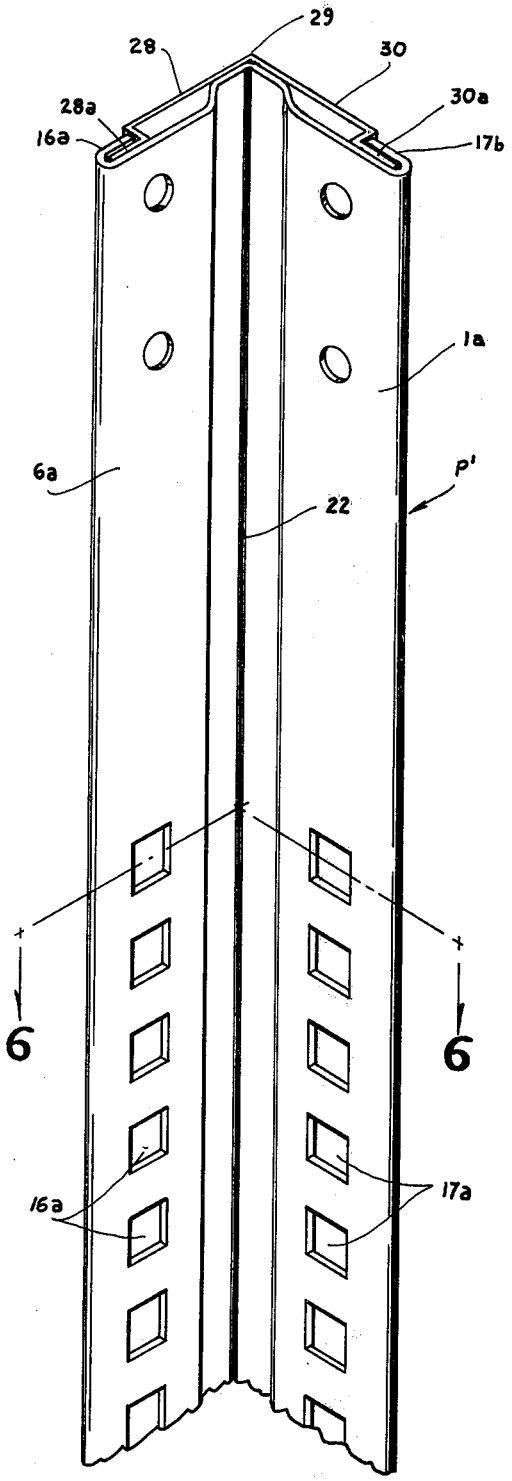
FIG. 5 is a view similar to FIG. 1 and which represents a second embodiment of the invention.
Figure 6:
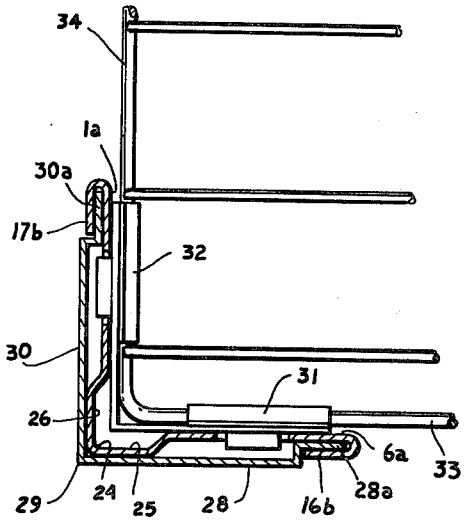
FIG. 6 is a cross sectional view taken along the line designated 6—6 in FIG. 5; and which also shows a wire shelf in place.
Figure 8:
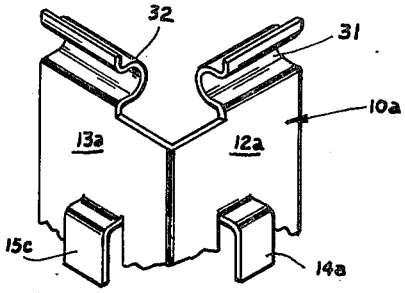
Figure 7:
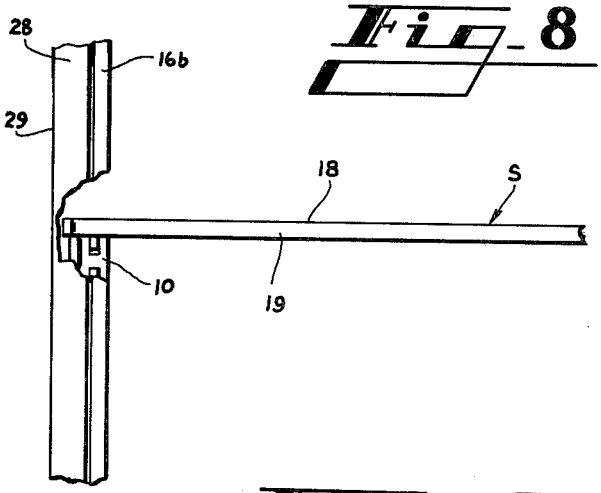
FIG. 7 is a view similar to FIG. 4 and which depicts the modification of the invention shown in FIGS. 5 and 6.

According to a second form of the invention, support strips may take the form shown in FIGS. 5 and 6 as indicated at 1a and 6a and these support strips may be secured together at their edges as indicated at 24. The corner at 24 is reinforced by offset portions 25 and 26 which add substantially to the resistance of the post to torsional and other stresses. A plurality of apertures 16a are formed in support strip 6a and similarly, a plurality of spaced apertures 17a are formed in support strip 1a.

As is best shown in FIG. 6, a sheath may be provided and may comprise a first sheath strip 28 secured at 29 to a second sheath strip 30 and these sheath strips may be disposed along the outer surfaces of support strips 16a and 17a respectively. As is best shown in FIG. 6, sheath strip 28 is provided with an inwardly offset edge portion 28a while sheath strip 30 is provided with an inwardly offset edge 30a. Furthermore support strip 6a is provided with turned over edge portion 16b which envelopes the inwardly offset edge 28a of sheath strip 28. Similarly support strip 1a is provided with turned over edge portions 17b which envelope the inwardly offset edge portion 30a of the sheath strip 30. The offset panels 25 and 26 add strength to the corner by locating the corner 24 immediately adjacent corner 29 and also afford space between support strips 1a and 16a and the sheath strips 28 and 30.

From the description in connection with FIGS. 1–4 inclusive, it is apparent that support clip 10a having reversely curved parts 31 and 32 is mounted on the structure shown in FIG. 6 by simply inserting the support tabs 14a into certain apertures 16a and by inserting the support tabs 15c into selected apertures 17a. The vertically disposed parts such as 15b of support tabs 15c are interposed between the support strip 1a and the sheath strip 30 and wire 33 of wire shelf 34 is interposed between support strips 1a and 16a and the curved parts 31 and 32 of panels 12a and 13a.

It is apparent that the arrangement represented by FIGS. 5, 6, 7, 8 and 9 in the drawings like the modification of FIGS. 1–4 provides a secure support for a shelf S which prevents substantial relative horizontal movement between each corner post and the associated shelf while providing an adjustable mounting means which is both sturdy structurally and attractive in appearance.

It is obvious that clip 10 could also be used with the post shown in FIGS. 5 and 6 particularly if the associated shelf were of metal with a depending edge skirt. Also it is apparent that the clip 10a could be used with the post of FIGS. 5 and 6 particularly if a wire shelf is employed. Also either clip 10 or 10a may include or omit a diagonal panel such as 11.

The embodiments of the invention in which an exclusive property or privilege is claimed are defined as follows:

1. Support structure for a shelf having a horizontal planar element from the edge of which a vertical edge portion depends, said structure comprising a vertically disposed post having a pair of vertically disposed support strips fixed in angular relation to each other, a plurality of apertures formed in each of said support strips and disposed in vertically spaced relationship, a pair of spaced generally parallel flange panels whose height corresponds with the height of said support strips and to corresponding edges of which the outer edges of said support strips are respectively secured, and web structure including a central web strip to the edges of which a pair of side web strips are secured and the angles between said central web strip and said side web strips being oblique, said side web strips having spaced outer edges to which the edges of said flange panels remote from said support strips are respectively secured, a support clip having a pair of vertically disposed support panels fixed in angular relation to each other and respectively disposed adjacent said support strips in complementary relation thereto, the angular relation between said support panels corresponding generally with that between said support strips, and at least one support tab on each of said support panels and disposed in an aperture in the associated one of said support strips, said support tabs being configured so that the edge portion of the shelf may be inserted between said support strips and their corresponding support panels.

2. Support structure for a shelf having a horizontal planar element having generally parallel side and end edges from which vertical edge portions depend, said structure comprising a vertically disposed post having a pair of vertically disposed support strips fixed in angular relation to each other, the angular relation between said support strips corresponding generally with the angle between adjacent ones of said vertical edge portions, a plurality of apertures formed in each of said support strips and disposed in vertically spaced relationship, a support clip having a pair of vertically disposed support panels fixed in angular relation corresponding generally with that between said support strips, said support panels being disposed adjacent said support strips respectively in complementary relation thereto, at least one support tab mounted on each of said support panels and disposed in an aperture in the associated one of said support strips, said support tabs being configured so that an edge portion of the shelf is removably disposed between each of said support panels and the associated one of said support strips, and a pair of vertically disposed generally parallel side panels secured along their corresponding edges to the outer edges of said support strips, the angle between each of said support strips and the associated side panel being acute.

3. Support structure according to claim 2 wherein a pair of vertically disposed side web strips are respectively secured to the edges of said side panels remote from said support strips, the angle between each of said side panels and the associated one of said side web strips being acute.

4. Support structure according to claim 3 wherein a vertically disposed central web strip is adjoined along its side edges to the edges of said side web strips respectively which are remote from the corresponding side panels, the angle between said central web strip and each of said side web strips being obtuse.

* * * * *